US007500560B2

(12) United States Patent
Fair et al.

(10) Patent No.: US 7,500,560 B2
(45) Date of Patent: Mar. 10, 2009

(54) GOLF STANDBAG FOOT ACTUATION ASSEMBLY

(75) Inventors: Paul Fair, Denver, CO (US); Jamie Kummerfeld, Denver, CO (US)

(73) Assignee: TRG Accessories, L.L.C., St. Louis, MO (US)

( * ) Notice: Subject to any disclaimer, the term of this patent is extended or adjusted under 35 U.S.C. 154(b) by 613 days.

(21) Appl. No.: 10/885,849

(22) Filed: Jul. 7, 2004

(65) Prior Publication Data

US 2006/0006085 A1 Jan. 12, 2006

(51) Int. Cl.
*A63B 55/00* (2006.01)
*A63B 55/06* (2006.01)

(52) U.S. Cl. ..... 206/315.7; 206/315.3; 248/96

(58) Field of Classification Search ..... 206/315.3, 206/315.7; 280/DIG. 6; 248/96
See application file for complete search history.

(56) References Cited

U.S. PATENT DOCUMENTS 1,769,011 A 7/1930 Bickford
1,970,849 A 8/1934 Gunther
2,186,491 A 1/1940 Meyer
4,834,235 A * 5/1989 Solheim et al. ..... 206/315.7
5,038,984 A 8/1991 Izzo
5,303,888 A * 4/1994 Seop ..... 248/96
5,356,003 A * 10/1994 Gretz et al. ..... 206/315.7
5,415,285 A 5/1995 Reimers
5,613,604 A * 3/1997 Maeng ..... 206/315.7
5,762,189 A 6/1998 Reimere
5,785,173 A * 7/1998 Kim ..... 206/315.6
5,816,544 A 10/1998 Hsieh
5,823,485 A 10/1998 Park
5,829,719 A 11/1998 Han
5,857,567 A 1/1999 Cheng
5,901,845 A 5/1999 Cheng
5,996,789 A 12/1999 Suggs et al.
6,010,101 A * 1/2000 Stein et al. ..... 248/96
6,062,383 A 5/2000 Han
6,098,797 A 8/2000 Han
6,168,123 B1 1/2001 Stein et al.
6,220,433 B1 4/2001 Kang
6,241,202 B1 6/2001 Chen
6,290,061 B1 9/2001 Chen
6,298,988 B1 10/2001 Wen-Chien
6,311,836 B1 11/2001 Maeng
6,315,117 B1 11/2001 Han
6,325,208 B1 * 12/2001 Cheng ..... 206/315.7
6,386,362 B1 * 5/2002 Cheng ..... 206/315.3
6,564,937 B1 * 5/2003 Cheng ..... 206/315.7
6,568,527 B1 * 5/2003 Te-Pin ..... 206/315.3
6,609,615 B2 8/2003 Lin
6,634,497 B1 10/2003 Chang
6,817,469 B2 11/2004 Chang
6,932,762 B2 8/2005 Ayame et al.
6,938,762 B2 9/2005 Cheng (Continued)

*Primary Examiner*—Sue A Weaver
(74) *Attorney, Agent, or Firm*—Armstrong Teasdale LLP

(57) ABSTRACT

A golf bag includes a body having opposite upper and lower ends and a compartment therebetween configured to contain golf clubs, and a base ring enclosing the body proximate the lower end. A foot is coupled to the base, wherein the base ring is pivotably mounted to the foot adjacent an outer perimeter of the base. The base ring is movable over the foot between a standing position and an inclined position when the foot is located stationary on a supporting surface.

27 Claims, 9 Drawing Sheets

U.S. PATENT DOCUMENTS

2002/0017471 A1* 2/2002 Rhee ..... 206/315.7
2002/0134894 A1 9/2002 Wang
2002/0195360 A1 12/2002 Hsieh
2003/0015634 A1 1/2003 Yoon
2004/0045780 A1* 3/2004 Bernbaum et al. ..... 190/109
2005/0072697 A1 4/2005 Yang
2005/0092631 A1* 5/2005 Campbell et al. ..... 206/315.7
2005/0178681 A1 8/2005 Wang

* cited by examiner

GOLF STANDBAG FOOT ACTUATION ASSEMBLY

CROSS REFERENCE TO RELATED APPLICATIONS

This application relates to U.S. application Ser. No. 10/885,848 filed Jul. 7, 2004 and entitled Golf Standbag Support Mount Assembly; U.S. application Ser. No. 10/885,846 filed Jul. 7, 2004 and entitled Golf Standbag Actuation Hinge Assembly; U.S. application Ser. No. 10/885,845 filed Jul. 7, 2004 and entitled Golf Bag with Self Actuating Stand; and U.S. application Ser. No. 10/886,089 filed Jul. 7, 2004 and entitled Baggage Lumbar Pad, the complete disclosures of which are hereby incorporated by reference in their entirety.

BACKGROUND OF THE INVENTION

This invention relates generally to baggage for being carried by a person and, more particularly, to golf bags having integrated stands which are deployable to support the bag in an inclined position on a ground surface.

While the game of golf is ever increasing in popularity, stowing and transporting golf equipment to, from, and around a golf course can be a drawback to an otherwise enjoyable experience. Traditionally, for most golfers, golf clubs are carried around the course in a bag and laid on the ground when it is the golfer's turn to play. Picking up the bag and laying it down repeatedly during a game of golf, not to mention carrying a full bag of clubs, can be tiresome and inconvenient. It can also be difficult to access the bag to insert, remove, or switch golf clubs when the bag is on the ground. While carrying straps are typically provided, most golf bags are uncomfortable to carry for an extended period of time.

In an attempt to address these and other concerns, various types of golf bag stands have been developed which allow users to incline the bag in a supported position when the bag is not being carried, thereby keeping the bag off the ground and providing better access to the clubs during play. The support legs on such bags may extend or retract as needed. Known stand mechanisms, however, are disadvantaged in several aspects.

For example, support legs tend to be bulky and increase the weight of the bag and make it more difficult to carry when desired. Additionally, the support structure and support legs are typically mounted to the exterior of the bag and are subject to bending forces, especially at the connection points to the bag, when the bag is transported from place to place, such as in the trunk of a car. If the legs or mounting structure thereof are bent the benefits of the support structure are compromised. Further, in many bags the stands are actuated by accessible components which are exposed from an exterior of the bag. Thus, not only are actuating components unprotected but potentially hazardous conditions are created for golfers if fingers or clothing, for example, become caught or pinched in the moving components of the bag during actuation. Still further, many known stand assemblies are actuated through straps or other triggering members that create reliability issues as well as render the golf bag vulnerable to unexpected and inadvertent actuation of the legs.

Furthermore, of the various types of golf bags that have been developed which allow users to incline the bag in a supported position, the base assembly on such bags may pivot from a standing position to an inclined position. Known base assemblies, however, are disadvantaged in several aspects. For example, only a portion of the footprint of the bag may be in contact with the support surface when the bag is in each respective position. Thus, the bag has a reduced stability as only a portion of the base is actually supporting the bag at any one time which renders the bag susceptible to tipping when in use. Further, the pivoting portions of the base assembly may be vulnerable to damage from impact as the bag is handled and transported from place to place, such as in the trunk of a car.

BRIEF DESCRIPTION OF THE INVENTION

According to an exemplary embodiment of the present invention, a golf bag is provided. The golf bag comprises a body includes opposite upper and lower ends and a compartment therebetween configured to contain golf clubs, and a base ring enclosing the body proximate the lower end. A foot is coupled to the base, wherein the base ring is pivotably mounted to the foot adjacent an outer perimeter of the base. The base ring is movable over the foot between a standing position and an inclined position when the foot is located stationary on a supporting surface.

According to another exemplary embodiment of the present invention, a golf bag is provided. The golf bag comprises a body comprising opposite upper and lower ends and a compartment therebetween configured to contain golf clubs, and a base ring extending around a lower periphery of the body. The base ring includes a side wall and a hinge. A foot is coupled to the hinge wherein the base ring is rockable over the foot. The foot has a substantially planar lower surface and an upstanding side wall extending therefrom, wherein the upstanding side wall is extending within the side wall of the base ring. The base ring is selectively positionable between a standing position and an inclined position when the foot is located stationary on a supporting surface.

According to yet another exemplary embodiment of the present invention, a golf bag is provided. The golf bag comprises a body comprising opposite upper and lower ends and a compartment therebetween configured to contain golf clubs. A base ring extends around the body. The base ring includes a side wall and a hinge member extending therefrom. The side wall includes first and second inclined surfaces. A foot is coupled to base ring, and the foot has a substantially planar bottom surface and an upstanding side wall extending therefrom, wherein one of the base ring side wall inclined surfaces cooperates with the foot to support the body on a supporting surface in each of an inclined position and a standing position.

DETAILED DESCRIPTION OF THE INVENTION

Figure 1:
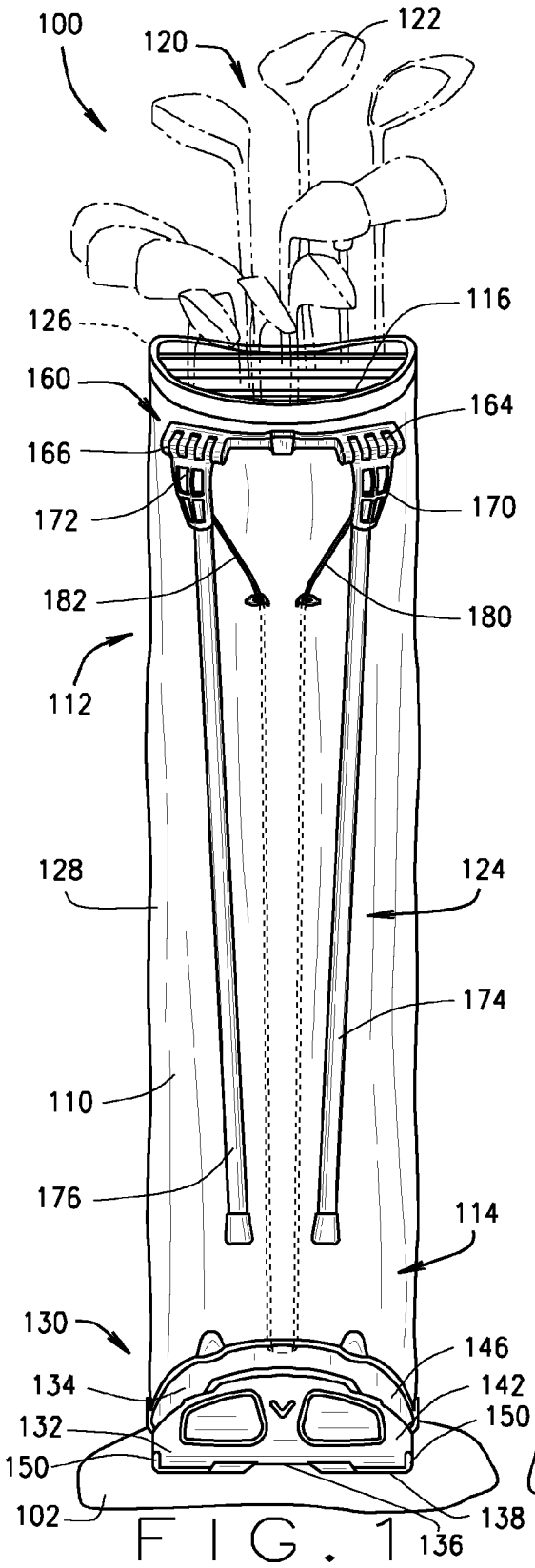
FIG. 1 is a front elevational view of an exemplary golf bag in an upright position with a self actuating stand in a stowed position.
Figure 2:
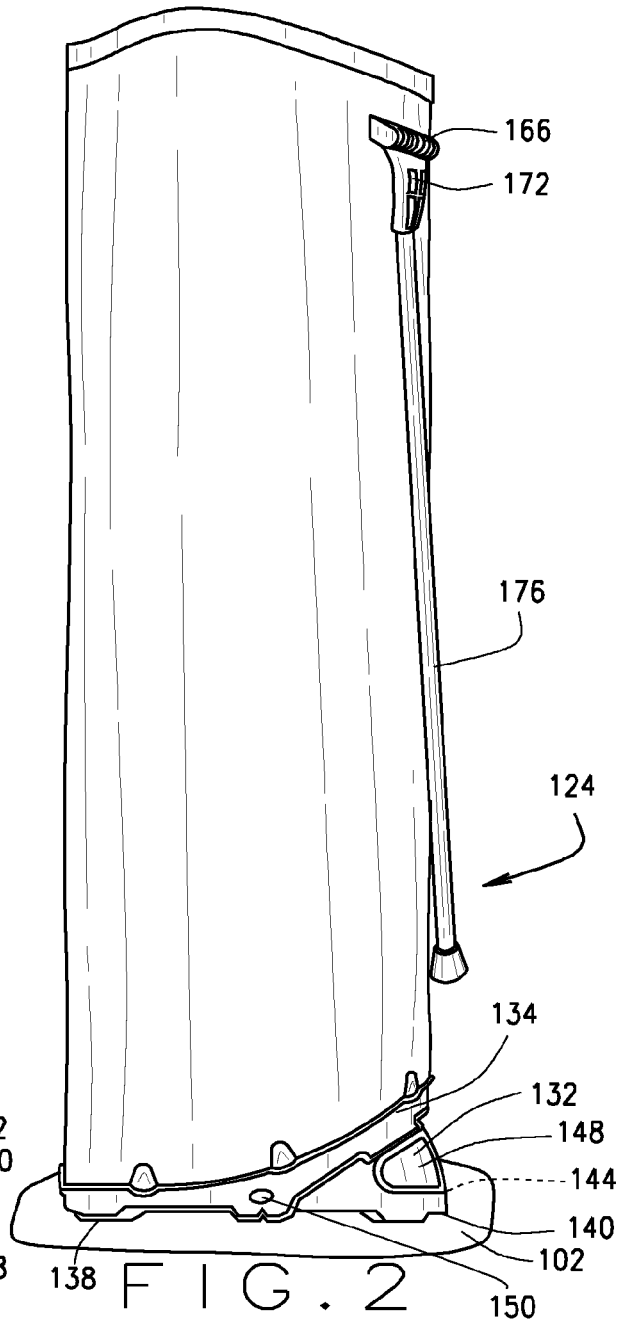
FIG. 2 is a side elevational view of the golf bag shown in FIG. 1.

FIGS. 1 and 2 illustrate a golf bag 100 in accordance with an exemplary embodiment of the present invention in a standing or substantially upright position with respect to a supporting surface 102, which may be, for example, the earth. The golf bag 100 includes an elongated body 110 including an upper end 112, a lower end 114, and a compartment 116 extending therebetween. The compartment 116 is sized and dimensioned to receive a set of golf clubs 120 therein such that heads 122 of the golf clubs are positioned proximate the upper end 112 of the golf bag 100 and the golf club grips are positioned proximate the lower end 114 of the golf bag 100. In an exemplary embodiment, the compartment 116 is defined by an inner liner 126 extending the length of the golf bag 100, although it is understood that in alternative embodiments the liner 126 may extend for less than the entire length of the bag 100. The body 110 is includes an outer covering 128 that extends from the upper end 112 to the lower end 114 of the body 110.

Figure 10:
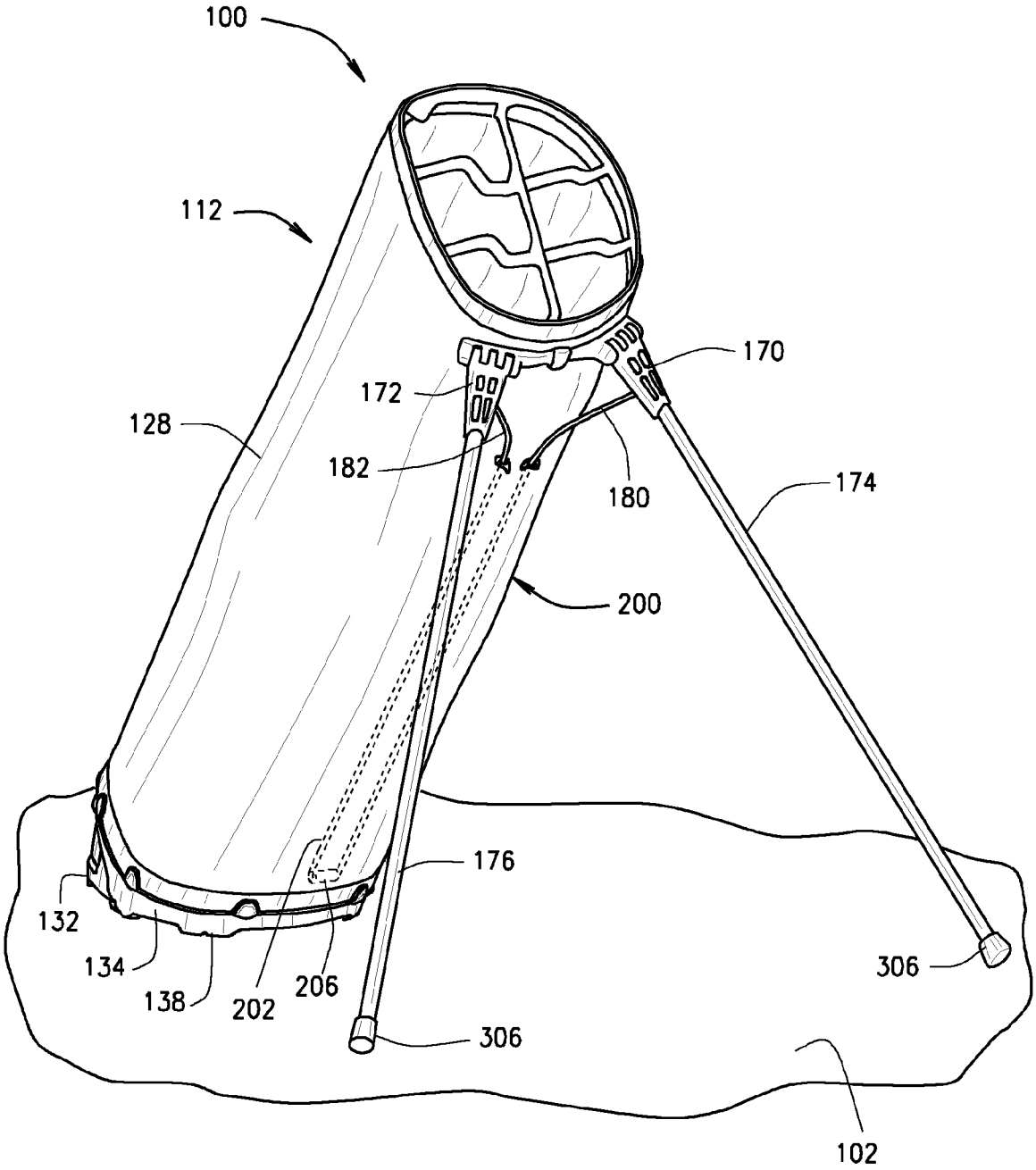
FIG. 10 is a perspective view of the golf bag shown in FIG. 1 in an inclined position with the stand deployed.

In an exemplary embodiment, the golf bag 100 includes a self actuating stand 124 having a base assembly 130 at the lower end 114 of the body 110, a support mount assembly 160 at the upper portion 112 of the bag 100, and an actuating mechanism extending therebetween as described below. As will become evident below, the stand 124 automatically extends to a deployed position when the bag 100 is placed in an inclined position as illustrated in FIG. 10.

The base assembly 130 includes a foot 132 and a base ring 134 attached thereto. When the golf bag 100 is in the upright position, as illustrated in FIGS. 1 and 2, the base assembly 130 is firmly and solidly in contact with the supporting surface 102. The foot 132 includes a planar bottom surface 136, a plurality of footholds 138 extending from a bottom 140 of the planar bottom surface 136 and contacting the supporting surface 102, and a side wall 142 extending from a top 144 of the planar bottom surface 136 toward the upper end 112 of the golf bag 100. The base ring 134 includes a side wall 146 that circumscribes an outer perimeter 148 of the foot 132, as best shown in FIG. 2. The base ring 134 is pivotably coupled to the foot 132 such that when the golf bag 100 is rotated from the upright position to the inclined position, the base ring 134 pivots about a joint 150 which couples the foot 132 to the base ring 134. As the golf bag 100 is moved between the upright and inclined positions, the footholds 138 remain in full contact with the supporting surface 102, thus providing stability to the bag 100 in both the upright and deployed positions.

The support assembly 160 includes a support mount 162, integral hinge members 164 and 166 extending from the support mount 162, hinge brackets 170 and 172 coupled to the hinge members 164 and 166, and support legs 174 and 176 coupled to the respective brackets 170 and 172. The hinge members 164 and 166 receive the hinge brackets 170 and 172 and allow a rotating movement therebetween. The support legs 174 and 176 are coupled to the respective hinge brackets 170 and 172 and are rotatable with respect to the support mount 162 between a stowed position and a deployed position when the bag 100 is inclined or returned to the upright position, as explained below. The support assembly 160 is mounted to the upper end 112 of the bag 100 and supports the golf bag 100 when the bag 100 is inclined (FIG. 10) and the support legs 174 and 176 are deployed and the legs 174 and 176 contact the supporting surface 102.

In the upright position, illustrated in FIGS. 1 and 2, the support legs 174 and 176 are retained in a retracted or stowed position alongside the outer covering 128 of the bag 100. Actuator arms 180 and 182 are coupled to the hinge brackets 170 and 172, respectively, to extend or retract the legs 174 and 176 between the stowed and deployed positions.

Figure 3:
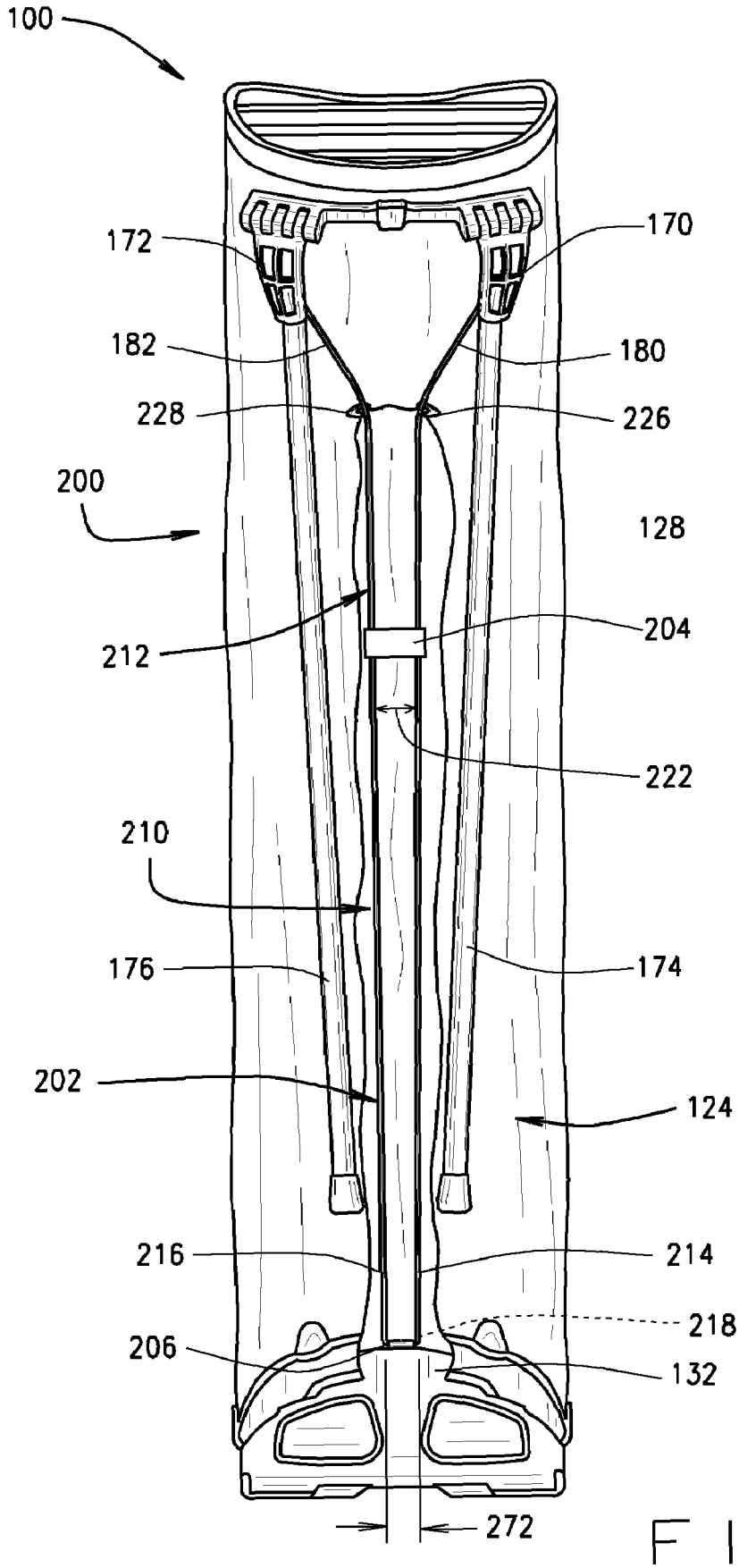
FIG. 3 is a front elevational cutaway view of the bag shown in FIG. 1 illustrating an exemplary actuation mechanism for the stand.

FIG. 3 illustrates a cutaway view of the golf bag 100 including an exemplary actuating mechanism 200 for the stand 124. The actuating mechanism 200 includes an activation rod 202, a brace 204, and a retention member 206. The activation rod 202 is a semi-rigid member that includes a lower portion 210 and an upper portion 212 having a generally Y-shaped form when viewed from the front, wherein the lower portion 210 includes a first leg 214 and a second leg 216, and the upper portion includes the first actuator arm 180 and the second actuator arm 182 extending as continuations from the respective legs 214, 216. In an exemplary embodiment, the activation rod 202 is fabricated from a substantially cylindrical metal shaft which is formed to include the lower and upper portions 210, 212 continuing from one another according to known techniques. It is contemplated, however, that other configurations of the activation rod 202 (i.e., other cross sectional shapes, materials and formations) may be employed in other embodiments.

The lower portion 210 of the activation rod 202 has a generally U-shaped configuration wherein the first leg 214 and the second leg 216 extend substantially longitudinally along the bag body 210 in a spaced apart relationship and a foot portion 218 extends transversely between and interconnects the legs 214 and 216. The foot portion 218 of the activation rod 202 is coupled to a retention member 206 of the foot 132, which retains the activation rod 202 in position relative to the foot 132. The legs 214 and 216 of the activation rod 202 extend from the foot portion 218 toward the upper end 112 of the golf bag 100 and the legs 214 and 216 are coupled to one another by a brace 204 at a distance from the foot portion 218 of the activation rod 202. The brace 204 retains each leg 214 and 216 of the activation rod 202 at a predetermined distance 222 from the opposing leg 214 or 216 and prevents the legs 214 and 216 from spreading apart or moving closer to one another at the location of the brace 204. As such, the brace 204 provides rigidity and stability to the activation rod 202, and ensures reliable operation of the actuating mechanism 200.

The lower portion 210 of the activation rod 202 is contained entirely within the outer covering 128 of the golf bag 100, and generally extends between the outer covering 128 and the inner liner 126 (FIG. 1) of the golf bag body 110. By locating the lower portion 210 of the activation rod 202 inside the bag 100, the rod 202 is protected by the outer covering 128 and is less likely to be damaged or dislodged during transport of the bag 100. Further, the enclosed actuation rod 202 at the lower end 114 of the bag 100 provides a safer actuating mechanism by preventing access to the actuating components, and safeguarding a user's clothing or fingers, for example, from becoming pinched or caught in the mechanism.

The upper portion 212 of the activation rod 202 includes the actuator arms 180 and 182 which extend outward in a V-shaped configuration relative to one another from the lower portion 210 of the activation rod 202. A portion of the actuator arms 180 and 182 proximate the legs 214 and 216 of the activation rod 202 are contained within the outer covering 128 of the golf bag 100, but the actuator arms 180 and 182 extend from the interior to the exterior of the bag 100 through corresponding slits or openings 226 and 228 in the outer covering 128 of the golf bag 100. The exterior ends of the actuator arms 180 and 182 are coupled to the corresponding hinge brackets 170 and 172. The actuator arms 180 and 182 function to retain the support legs 174 and 176 alongside the body 110 in the stowed position, or alternatively to extend the support legs 174 and 176 from the body 110 in the deployed position when the golf bag 100 is moved between the upright position and the inclined position.

Figure 4:
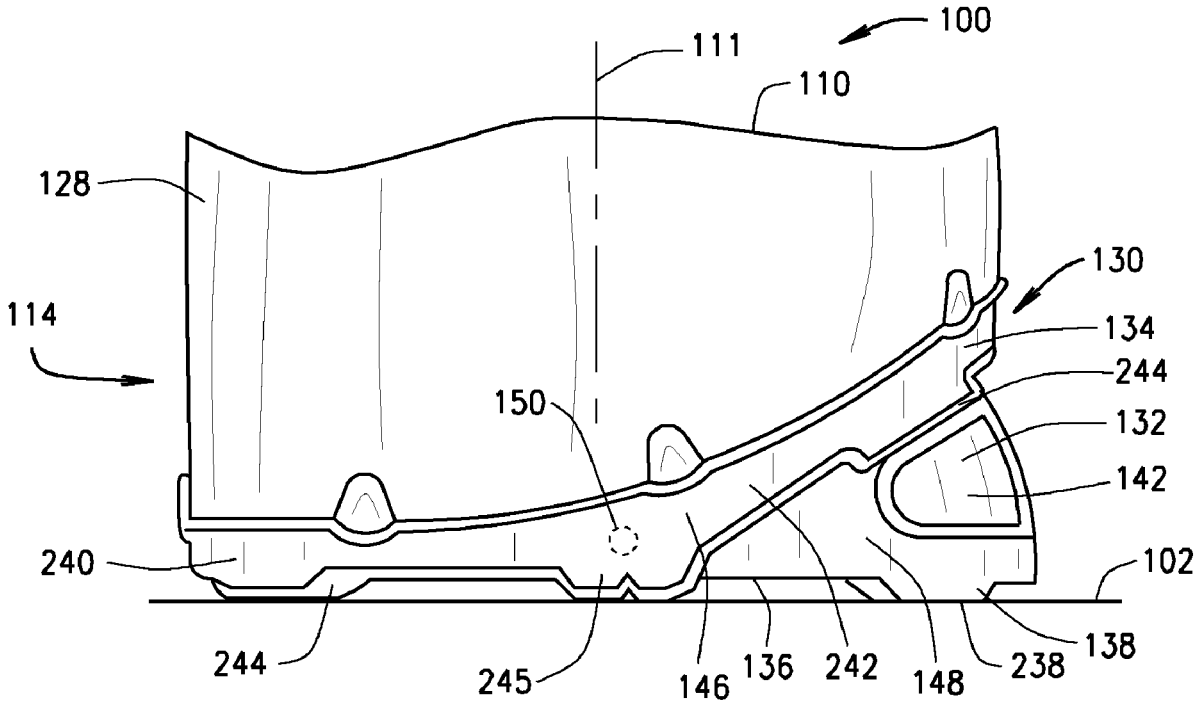
FIG. 4 is a side view of an exemplary base actuation assembly for the golf bag shown in FIG. 1 in the upright position.

FIG. 4 illustrates the base assembly 130 in the upright position wherein a longitudinal axis 111 of the body 110 is positioned approximately perpendicular to the supporting surface 102 above the foot 132. The footholds 138 extend downwardly from a substantially planar bottom surface 136 of the foot 132, and the side wall 142 extends upwardly from the planar bottom surface 136. The foot 132 is fabricated from a rigid material, such as, for example, plastic according to known techniques. The footholds 138 are formed with a generally flat bottom surface 238 which contacts the support surface 102. The side wall 142 extends upward from the planar bottom surface 136 in a direction toward the upper end 112 (FIG. 1) of the golf bag 100. In an exemplary embodiment, the side wall 142 is curvilinear and follows a curved path generally complementary to the curvature of the outer covering 128 of the golf bag 100.

Figure 8:
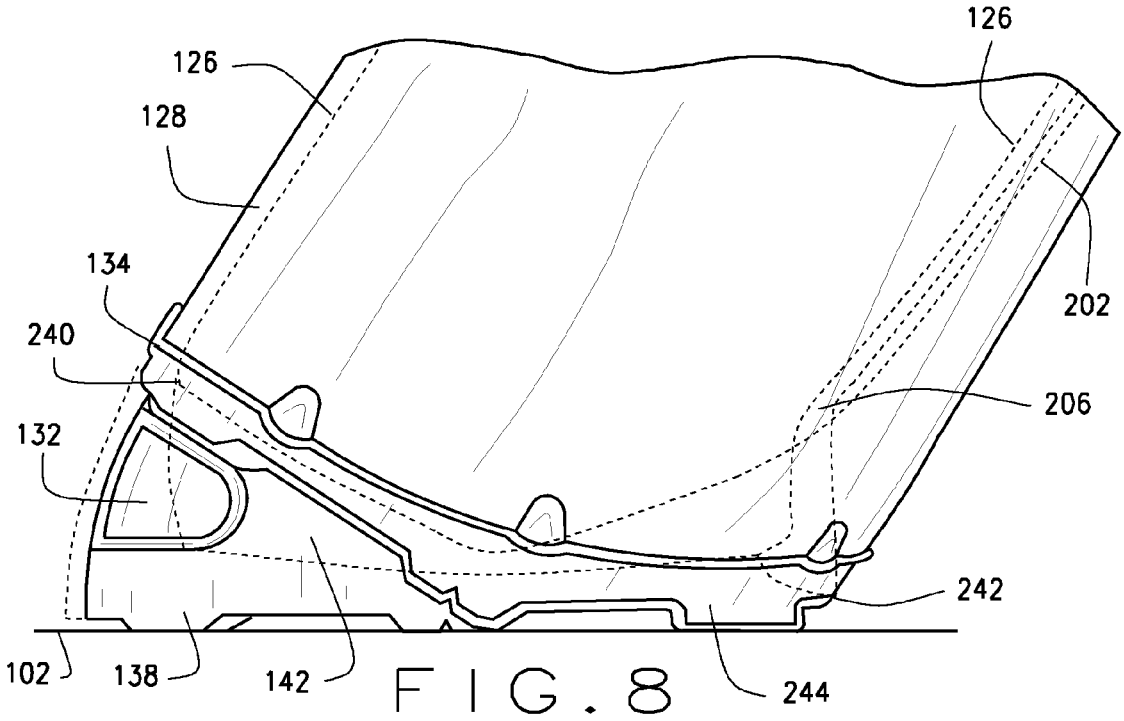
FIG. 8 is a side view of the base actuation assembly shown in FIG. 4 in a deployed position with the bag inclined over the base.

The side wall 146 of the base ring 134 circumscribes an outer perimeter 148 of the foot 132 and is attached to the outer covering 128 of the golf bag 100. The base ring 134 is connected to the foot 132 via the joint 150 and is movable relative to the foot 132 between the upright position and a deployed position (FIG. 8) when the bag 100 is inclined. The base ring 134 has an angular shape defined by a first and second ring portions 240 and 242, each of which extends around approximately one half of the outer covering 128 of the bag 100. The ring portions 240 and 242 are canted or angled with respect to one another, wherein the first ring portion 240 of the base ring 134 extends substantially parallel to the supporting surface 102 (FIGS. 1 and 2) when the bag 100 is in the upright position, while the second ring portion 242 of the base ring 134 is inclined or oriented at an angle with respect to the supporting surface 102. However, when the golf bag 100 is in the inclined position as illustrated in FIGS. 8 and 10, the base ring 134 is moved over the foot 132 via the hinge 150 such that the second ring portion 242 of the base ring 134 extends substantially parallel with the supporting surface 102 and the first ring portion 240 is oriented at an angle with respect to the supporting surface 102. Thus, when the golf bag 100 is moved between the inclined and the upright positions, the base ring 134 pivots over the foot 132 accordingly while the foot 132 remains in a stationary position relative to the supporting surface 102.

Each of the first and second ring portions 240 and 242 includes footholds 244 extending downwardly therefrom, which align with the footholds 138 of the foot 132 to further support the base assembly 130 in the upright and deployed positions. Center footholds 245 are also provided between the ring portions 240 and 242 proximate the joint 150 where the base ring 134 is attached to the foot 132. Thus, when the golf bag 100 is in the upright position of FIG. 4, the footholds 244 extending from the first ring portion 240 and the center footholds 245 of the base ring 134 are in contact with the supporting surface 102 to stabilize and support the full weight of the golf bag 100 and relieve pressure on the joint 150. As the golf bag 100 is inclined (FIGS. 8 and 10), the base ring 134 rotates or pivots over the foot 132 until the footholds 244 extending from the second ring portion 242 of the base ring 134 are in contact with the supporting surface 102 and support the golf bag 100 on the lower end 114 while the support legs 174 and 176 support the bag 100 on the upper end 112, thereby reducing the stress on the joint 150. In either position of the bag 100, the footholds 138 associated with the foot 132 remain in full contact with the supporting surface 102, thereby providing stability to the bag 100 in the upright position, the inclined position, and intermediate positions.

Figure 5:
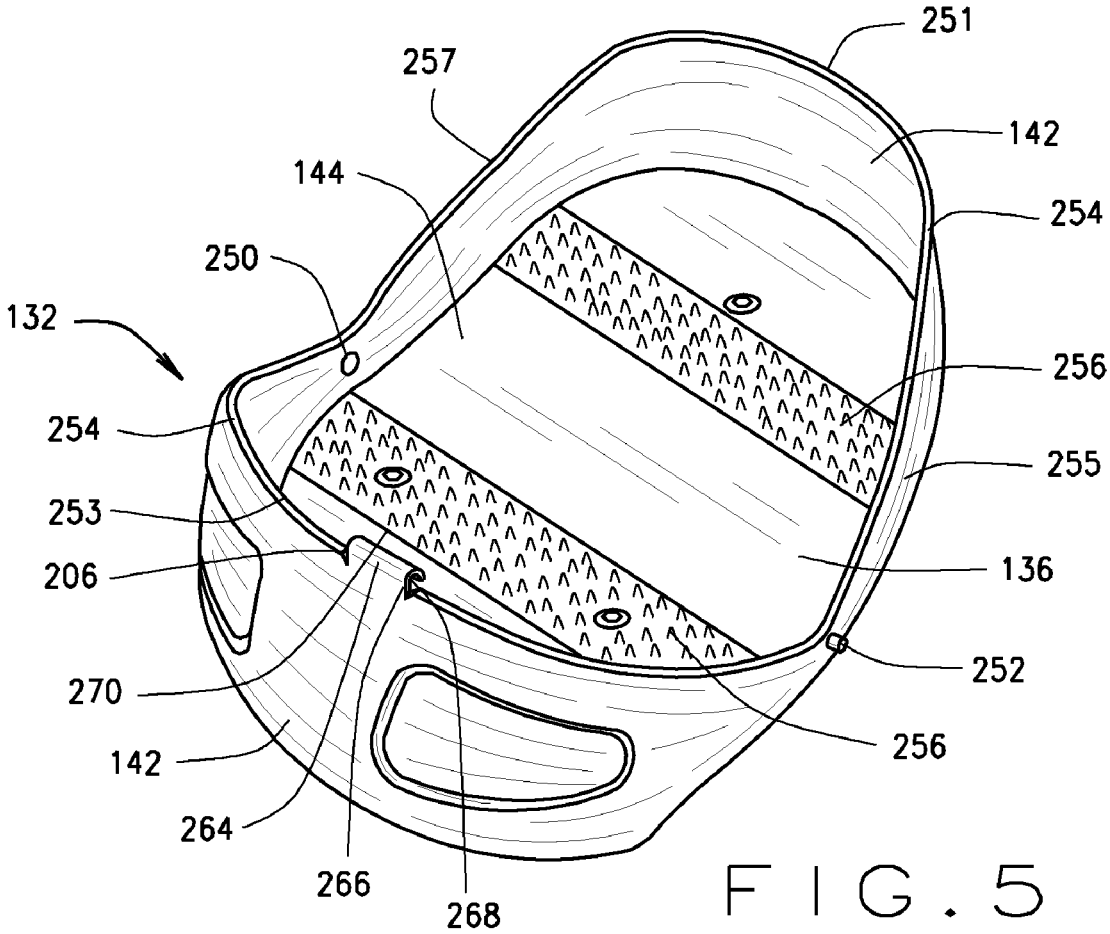
FIG. 5 is a perspective view of an exemplary foot for the base actuation assembly shown in FIG. 4.

FIG. 5 illustrates an exemplary embodiment of the foot 132 including the retention member 206 coupled to and extending from a top 256 of the side wall 142, first and second pegs 250 and 252 extending outwardly from the side wall 142, and a pair of fastener elements 256 coupled to the planar bottom surface 136 between opposing portions of the side wall 142. The side wall 142 extends upwardly from a top 144 of the planar bottom surface 136 and extends generally away from the supporting surface 102 (FIGS. 1 and 2), and the planar bottom surface 136 extends continuously within the confines of the side wall 142. The bottom surface 136 and the side wall 142 are fabricated in an exemplary embodiment from a rigid plastic material in a unitary construction which maintains the shape of the foot 132 and capably supports the weight of the golf bag 100 when loaded with clubs and golf gear.

The top 254 of the side wall 142 is sloped and generally defines opposite raised ends 251 and 253 and recessed sides 255 and 257 extending between the raised ends 251 and 253 in the side wall 142. The recessed sides 255 and 257 slope downwardly from each of the raised ends 251 and 253, and thus extend in a valley shape, with the joint 150 (FIG. 4) located approximately at the low point of the valley. The angle of the valley substantially corresponds to the angle between the ring portions 240 and 242 of the base ring 134 (FIG. 4).

Figure 6:
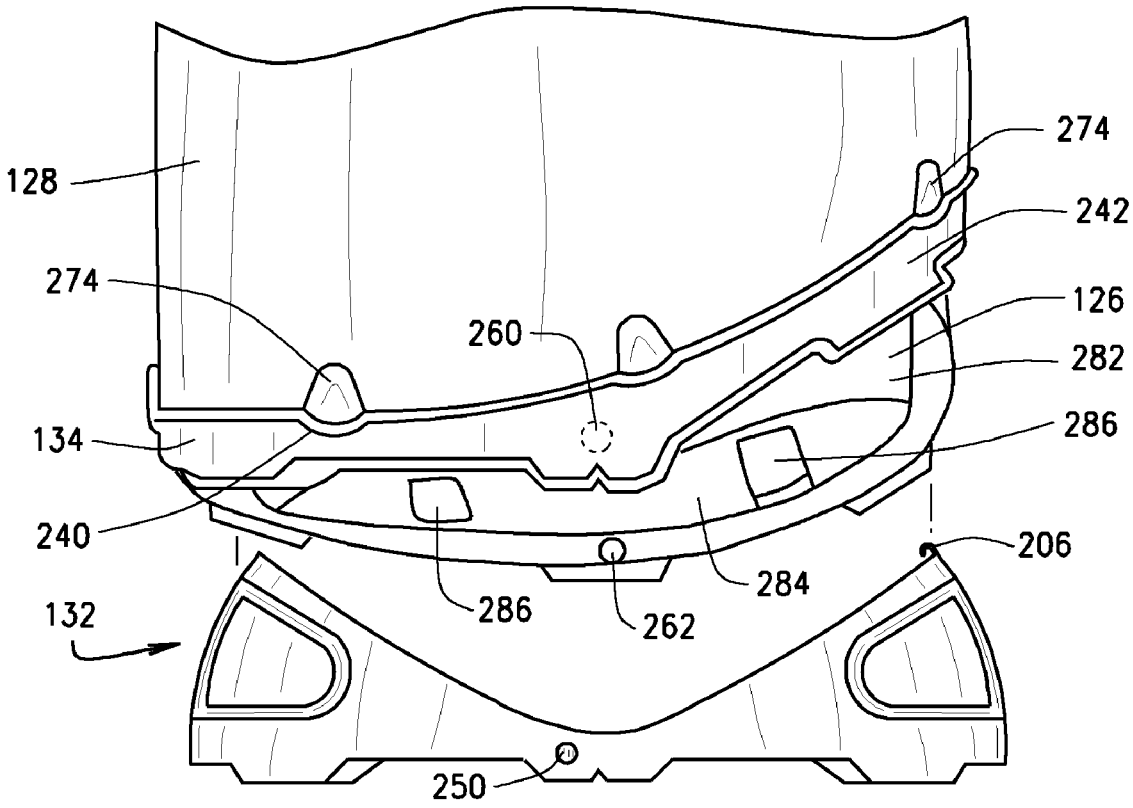
FIG. 6 is an exploded view of the base actuation assembly shown in FIG. 4.

The joint 150 includes first and second pegs 250 and 252 and corresponding openings 260 and 262 in the base ring 134, as shown in FIG. 6. The first and second pegs 250 and 252 extend from the side wall 142 outwardly or away from the interior of the foot 132. The pegs 250 and 252 are located on opposing sides of the foot 132, and are retained by the openings 260 and 262 located in the base ring 134, as described below. In an exemplary embodiment, the pegs 250 and 252 are integrally formed with the foot 132, although it is contemplated that they may be provided separately in other embodiments.

As illustrated in FIG. 5, the retention member 206 extends upwardly from the top wall 254 of the foot 132 at the raised end 253 and is substantially centered between the valleys of the recessed sides 255, 257 of the sidewall 142. In use, the foot portion 218 (FIG. 3) of the activation rod 202 is coupled to the retention member 206 such that the activation rod 202 can be pivoted about the retention member 206 while being retained therein. In an exemplary embodiment, the retention member 206 is, for example, a clip 264 having an inner surface 266 defining a slot 268. The clip 264 has a length 270 which is approximately equal to the width 272 of the foot portion 218 of the activation rod 202, as shown in FIG. 3, such that the activation rod 202 can be inserted into the slot 268 defined by the inner surface 266 of the clip 264. However, other types of retention members 206 can be utilized to retain the activation rod 202 in contact with the foot 132, such as, for example, a strap, or another fastener familiar to those in the art.

The fasteners 256 are coupled to the top 144 of the planar bottom surface 136 and are used to fasten a bottom portion 284 (FIG. 6) of the inner liner 126 to the planar bottom surface 136 of the foot 132. In an exemplary embodiment, the fasteners 256 are, for example, commercially available Velcro® brand fastener strips. Other types of fasteners 256, however, can be used, such as, for example, an interlocking device, a rivet, a locking mechanism, a tying system, or a clip.

FIG. 6 illustrates an exploded view of the lower end 114 of the golf bag 100 including the outer cover 128, the inner liner 126, the base ring 134, and the foot 132. The ring portions 240 and 242 of the base ring 134 are coupled to the outer cover 128 of the golf bag 100 using a known fastener 274, such as, for example, a snap fastener. However, other known fasteners 274 can be utilized such as, by way of example only, an interlocking device, a rivet, a hook and loop fastener, a locking mechanism, a tying system, or a clip. The foot 132 is coupled to the base ring 134 at the joint 150 via the pegs 250 and 252 of the foot 132 and the corresponding openings 260 and 262 located within the base ring 134. In an alternative embodiment, the pegs 250 and 252 may be formed with the base ring 134 and the openings 260 and 262 may be formed within the foot 132 in lieu of the above-described embodiment.

In an exemplary embodiment, the inner liner 126 includes an outer perimeter 282 complementary in shape to the outer covering 128 and which is located adjacent to the outer covering 128. A bottom portion 284 of the inner liner 126 encloses the compartment 116 (FIG. 1) for housing the golf clubs 120. The bottom portion 284 of the inner liner 126 includes fasteners 286 coupled thereto for interfacing with the fasteners 256 coupled to the foot 132. In an exemplary embodiment the fasteners 286 associated with the inner liner 126 are, for example, Velcro® brand fastener strips. However, other types of fasteners can be used, such as, for example, an interlocking device, a locking mechanism, a tying system, or a clip. The fasteners 286 of the inner liner 126 couple the bottom portion 284 of the inner liner 126 to the planar bottom surface 136 of the foot 132. As such, the bottom of the compartment 116 of the bag 100 substantially corresponds to the bottom surface 136 (FIG. 5) of the foot 132.

Figure 7:
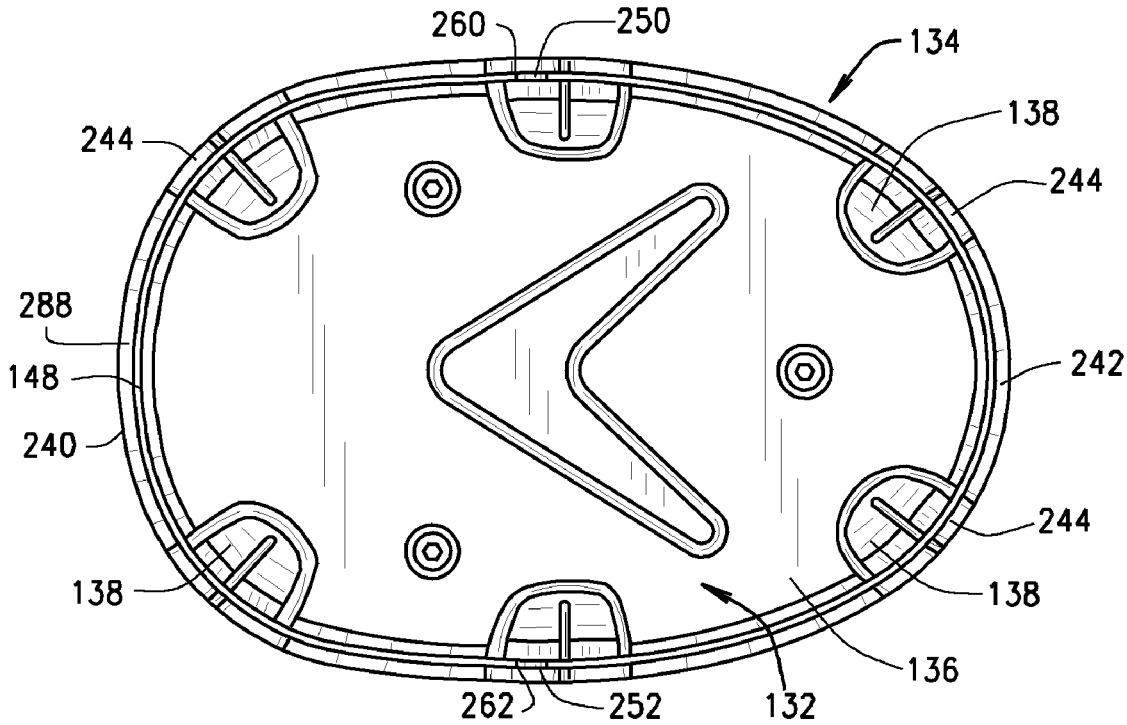
FIG. 7 is a bottom assembly view of the base actuation assembly shown in FIG. 4.

FIG. 7 illustrates the base assembly 130 wherein the plurality of footholds 138 are dispersed around the outer perimeter 148 of the planar bottom surface 136. The first ring portion 240 of the base ring 134 has a perimeter 288 that is substantially similar and adjacent to the outer perimeter 148 of the foot 132, while the second ring portion 244 is angled with respect to the bottom planar surface 136 of the foot 132. The base ring 134 is coupled to the foot 132 at the joint 150, wherein the pegs 250 and 252 extend from the foot 132 into the openings 260 and 262 located within the base ring 134. The foot 132 encloses the entire lower end 114 of the body 110 of the golf bag 100, and thereby protects the actuation mechanism 200 (FIG. 3) at the lower end of the bag with the rigid bottom surface 136.

FIG. 8 illustrates the base assembly 130 when the golf bag 100 is in the inclined position wherein the base ring 134 has been pivoted about the joint 150 (FIG. 4). Notably, the foot 132 remains in a stationary position corresponding to the position of the foot 132 when the golf bag 100 is in the upright position (FIG. 4). That is, the foot 132 does not move in relation to the supporting surface 102 when the body 110 is moved between the upright and inclined positions. As illustrated in FIG. 8, the footholds 138 maintain contact with the supporting surface 102, and the forward-most footholds 244 associated with the base ring 134 are also in supporting contact with the supporting surface 102.

A portion of the actuating mechanism 200 is illustrated in phantom in FIG. 8, showing the position and attachment of the activation rod 202 in relation to the foot 132, the inner liner 126, and the outer covering 128. The activation rod 202 is pivotably coupled to the retention member 206, and when the golf bag 100 is moved to the inclined position, the position of the various bag components, such as, for example, the base ring 134 and the outer covering 128, change in relation to the position of the activation rod 202 thereby activating the actuating mechanism 200 to deploy the legs 174, 176 of the support stand, as described below.

Figure 9:
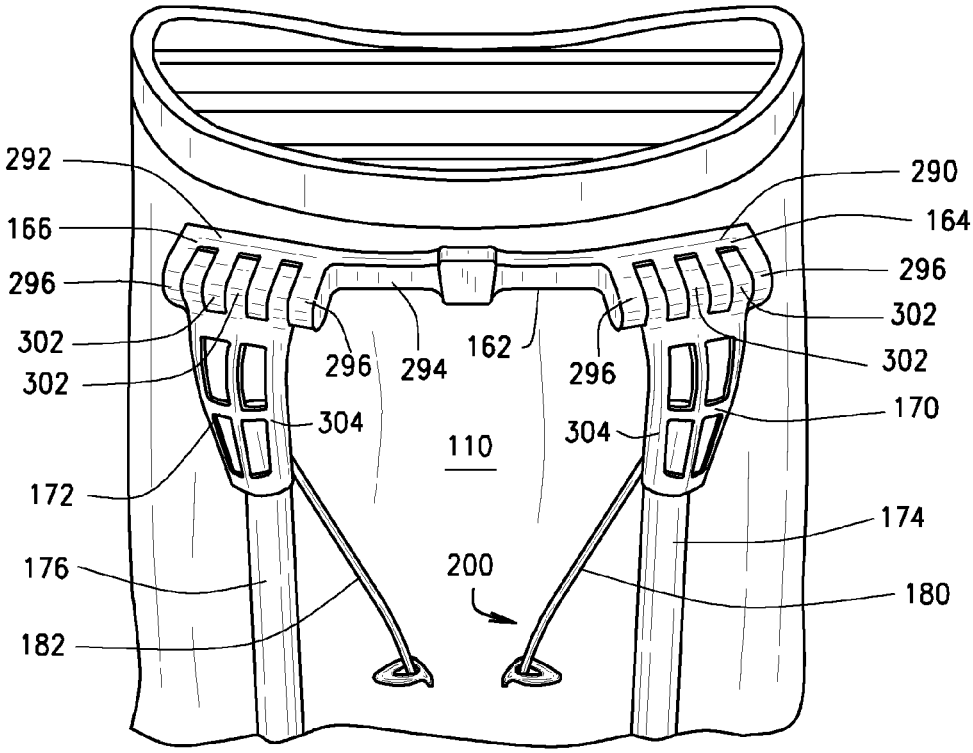
FIG. 9 is a front perspective view of an exemplary support mount assembly for the golf bag shown in FIG. 1.

FIG. 9 is a perspective view of the support mount 162, hinge members 164 and 166, hinge brackets 170 and 172, and corresponding support legs 174 and 176. The support mount 162 is coupled to the exterior of the golf bag body 110 and is located proximate to the upper end 112 of the body 110. The support mount 162 includes a first end 290, a second end 292, and a central bridge portion 294 extending therebetween. The hinge members 164 and 166 are located at the first and second ends 290 and 292, respectively, of the support mount 162. In an exemplary embodiment, the ends 290 and 292, together with the hinge members 164 and 166, and the bridge portion 294 are integrally formed and fabricated from metal, such as aluminum.

Interlocking hinge elements 296 extend from each of the hinge members 164 and 166 and interface with the hinge brackets 170 and 172, respectively, such that the hinge brackets 170 and 172 are rotatably mounted to the support mount 162. The hinge brackets 170 and 172 are in a stowed position alongside the bag 100 when the golf bag 100 is in the upright position and are in a deployed position when the golf bag 100 is in the inclined position. In an exemplary embodiment, the interlocking hinge elements 296 form a piano hinge with the hinge brackets 170 and 172, such that a plurality of fingers 302 extend from each of the hinge brackets 170 and 172, respectively and extend between the interlocking hinge elements 296. The fingers 302 overlap and interlock with the hinge elements 296 such that the hinge members 164 and 166 and the hinge brackets 170 and 172 are rotatably coupled to each other via, for example, a hinge pin (not shown) extending through the hinge elements 296 and the fingers 302.

As illustrated in FIG. 9, the actuator arms 180 and 182 extend from within the outer covering 128 of the golf bag 100 through respective slits 226 and 228, or openings, in the outer covering 128. The actuator arms 180 and 182 are coupled to the respective hinge brackets 170 and 172 using a fastener 304, such as, for example, a pin or bolt. However, other known fasteners 304 can be utilized. As further illustrated in FIG. 9, the support legs 174 and 176 are coupled to the hinge brackets 170 and 172 and extend away from the support mount 162 towards the lower end 114 of the golf bag 100.

FIG. 10 illustrates the golf bag 100 in the inclined position with the legs 174 and 176 deployed. The actuating mechanism 200 is engaged, or activated, when the golf bag 100 is rotated from the upright position (FIGS. 1 and 2) to the inclined position (FIG. 10), wherein the base ring 134 is pivoted upon the foot 132. As such, the relative position of the base ring 134 and the outer covering 128 of the golf bag 100 change with respect to the retention member 206 and the activation rod 202. Due to this change in position of the golf bag 100 relative to the activation rod 202, the actuator arms 180 and 182 are displaced relatively closer to the upper portion 112 of the bag 100, thereby forcing more of the actuator arms 180 and 182 out of the internal portion of the golf bag 100 and causing the actuator arms 180 and 182 to actuate the hinge brackets 170 and 172 and the support legs 174 and 176 from the stowed position to the deployed position. As such, no external triggering components are needed to actuate the support legs 174 and 176, and the legs 174 and 176 are self-extending as the bag 100 is inclined. As the legs 174 and 176 are extended, they are splayed from one another such that shoes 306 coupled to the legs 174 and 176 contact the supporting surface 102 and capably support the golf bag 100 in the inclined position while the footholds 138 remain in a stationary position in full contact with the supporting surface 102. As the bag 100 is moved back toward the upright position, the actuator arms 180 and 182 pull the support legs 174 and 176 back to the stowed position alongside the body of the bag.

Figure 11:
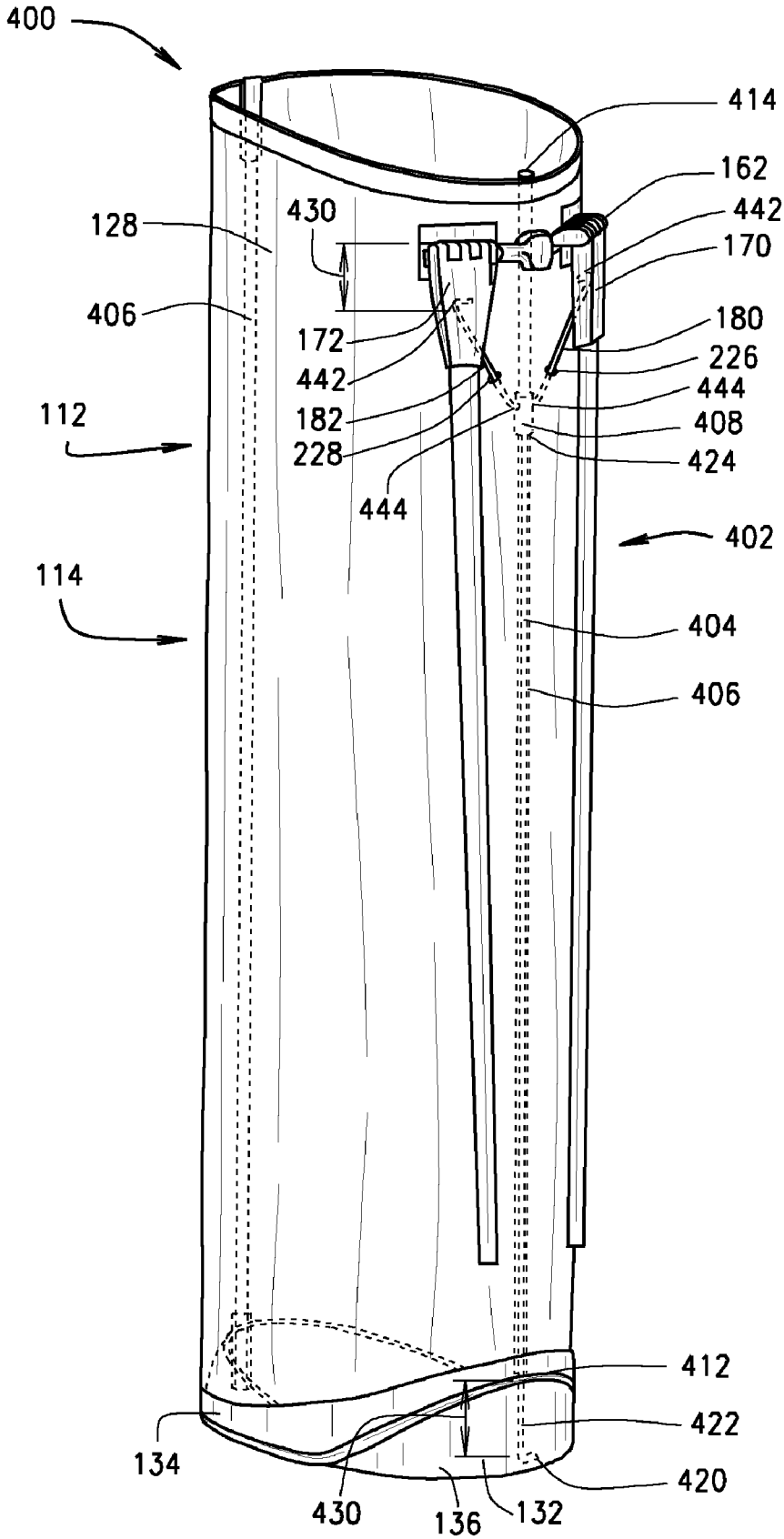
FIG. 11 is a schematic view of another exemplary embodiment of a golf bag having a self actuating stand.

FIG. 11 illustrates an alternative embodiment of a golf bag 400 having an actuating mechanism 402 including an activation rod 404 attached to the planar bottom surface 136 of the foot 132, an internal stay 406 attached to the base ring 134, an actuator 408 attached to the activation rod 404, and the first and second actuator arms 180 and 182 attached to the actuator 408. The actuating mechanism 402 is engaged, or activated, when the golf bag 400 is rotated from the upright position to the deployed position, and the actuating mechanism 402 is located interior to the outer covering 128 of the golf bag 400, which hides the components for protection, safety and reliability.

The golf bag 400 includes a plurality of internal stays 406 which support the golf bag 400, giving the golf bag 400 its shape. In one embodiment the stays 406 are cylindrical and hollow and have a length such that a first end 412 and a second end 414 of the internal stay 406 extend from the lower end 114 of the golf bag 400 to the upper end 112 of the golf bag 400 respectively. The internal stays 406 are contained within the outer covering 128 of the golf bag 400 so as to not be exposed to external elements. In an exemplary embodiment, the stays 406 are connected to the base ring 134. The golf bag 400 has a single shaft activation rod 404 which is located interior to the outer covering 128 of the golf bag 400, and more specifically, is located at least partially within the hollow cavity of the internal stay 406. However, in the upright position, the lower portion of the activation rod 404 extends beyond the first end 412 of the internal stay 406 to the planar bottom surface 136 where it is pivotably coupled to a retention member 420 connected to the foot 132.

As illustrated in FIG. 11, the activation rod 404 is a single cylindrical shaft having a single longitudinal axis extending within the internal stay 406 towards the upper end 112 of the golf bag 400. The activation rod 404 has a first end 422 coupled to the retention member 420, and a second end 424 located proximate to the upper end 112 of the golf bag 400. When the golf bag 400 is rotated to the inclined position, the internal stay 406, which is coupled to the base ring 134, is moved downward a distance 430 along the rod longitudinal axis until the stay first end 412 and the rod first end 422 are adjacent.

A sliding actuator 408 is located proximate to the second end 424 of the activation rod, and in one embodiment, is coupled to the second end 424 and surrounds the internal stay 406 such that the actuator 408 is moveable relative to the internal stay 406. The actuator 408 is contained within the outer covering 128 of the golf bag 400. The actuating mechanism 402 includes the first and second actuator arms 180 and 182, each having a first end 442 and a second end 444. In an illustrative embodiment, the first ends 442 of the actuator arms 180 and 182 are coupled to opposing sides of the actuator 408. The actuator arms 180 and 182 extend from the interior of the outer covering 128 to the exterior of the bag 400 through corresponding slits 226 and 228, or openings, in the outer covering 128 in a V-configuration. The second ends 444 of the actuator arms 180 and 182 are coupled to corresponding hinge brackets 170 and 172.

In use, when the golf bag 400 is moved to the inclined position, as described above, the internal stay 406 moves downward on the cylindrical shaft of the activation rod 404 the predetermined distance 430. Correspondingly, the second end 414 of the internal stay 406, or more particularly the support assembly 160, moves downward the same distance 430 such that the actuator 408 and the support mount 162 are forced relatively closer to each other. Due to this decrease in relative distance between the actuator 408 and the support mount 162, the actuator arms 180 and 182 force the corresponding hinge brackets 170 and 172 and support legs 174 and 176 to rotate, or swing, in a direction away from the golf bag 400 and into the support position.

Figure 12:
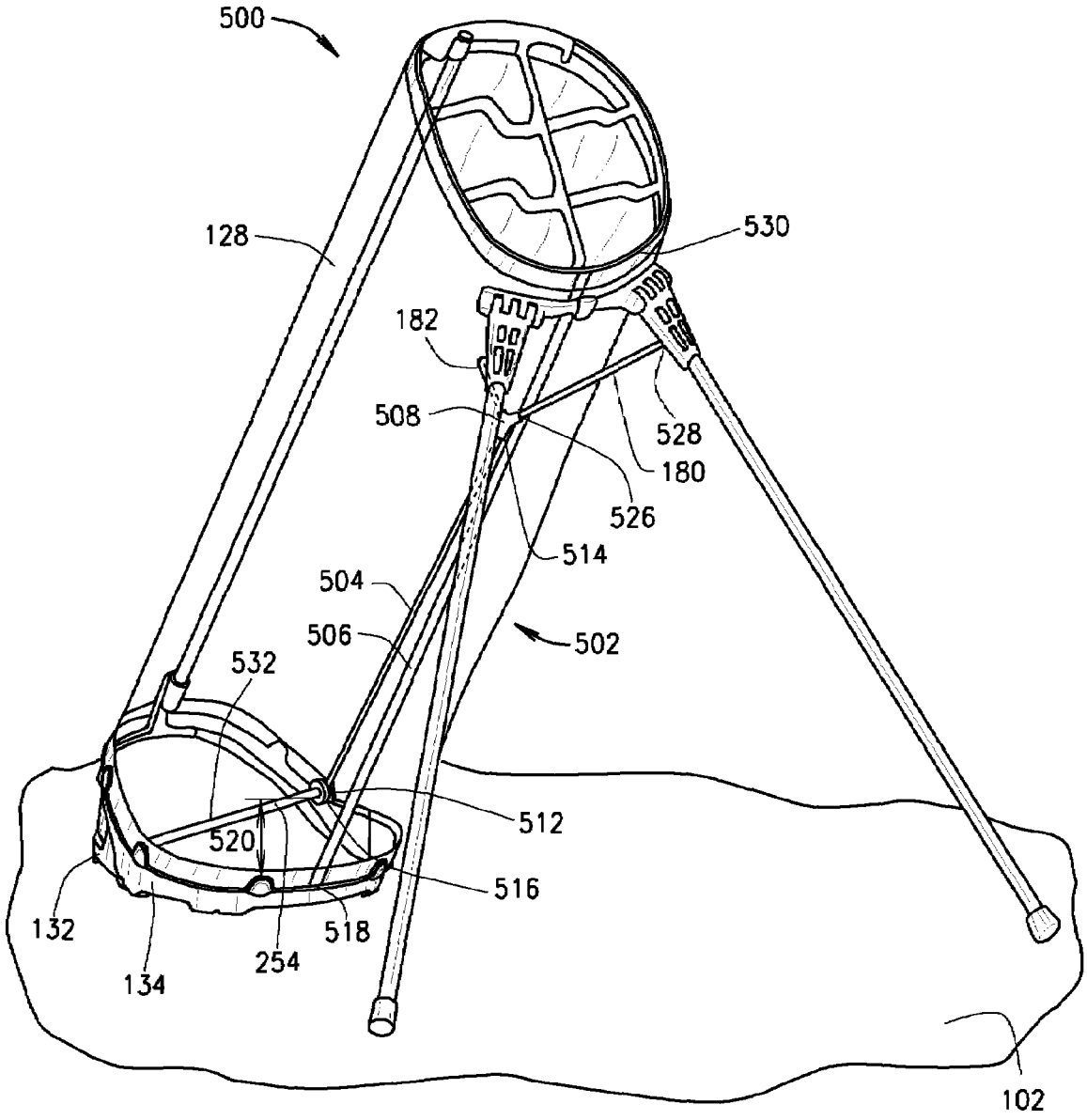
FIG. 12 is a schematic view of still another exemplary embodiment of a golf bag having a self actuating stand.

FIG. 12 illustrates another embodiment of a golf bag 500 having an actuating mechanism 502 including a single activation rod 504 rotatably coupled to the top wall 254 of the foot 132, an internal stay 506 attached to the base ring 134, an actuator 508 coupled to the activation rod 504, and the first and second actuator arms 180 and 182 attached to the actuator 508. The actuating mechanism 502 is engaged, or activated, when the golf bag 500 is rotated from the upright position to the inclined position. The actuating mechanism 502 is located interior to the outer covering 128 of the golf bag 500, which hides the components for protection, safety and reliability.

The activation rod 504 has a first end 512 and a second end 514 such that the first end 512 is rotatably coupled to a retention member 516 located at the top wall 254 of the foot 132, and the second end 514 is located proximate to the upper end 112 of the golf bag 500. When the golf bag 500 is in the upright position, the first end 512 of the activation rod 504 and a first end 518 of the internal stay 506 are adjacent to one another. However, when the golf bag 500 is transferred to the deployed position the internal stay 506 is moved downward a distance 520 along the outer periphery of the foot side wall 142 towards the support surface 102, and is positioned remotely with respect to the first end 512 of the activation rod 504 which remains fixed at the top wall 254 relative to the support surface 102.

The actuator 508 is located proximate to the second end 514 of the activation rod 504, and in one embodiment, is coupled to the second end 514. The actuator 508 is contained within the outer covering 128 of the golf bag 500. A first end 526 of each actuator arm 180 and 182 is coupled to opposing sides of the actuator 508. The actuator arms 180 and 182 extend from the interior of the outer covering 128 to the exterior of the bag 500 through corresponding slits 226 and 228 (FIG. 11), or openings, in the outer covering 128 in a V-configuration. A second end 528 of each actuator arm 180 and 182 is coupled to the corresponding hinge bracket 170 and 172.

In use, when the golf bag 500 is moved to the inclined position, as described above, the internal stay 506 moves downward the distance 520 relative to the activation rod 504. Correspondingly, a second end 530 of the internal stay 506, or more particularly the support assembly 160, moves a substantially similar distance downward towards the actuator 508 forcing the actuator 508 and the support mount 162 to be positioned relatively closer to each other. Due to this decrease in relative distance between the actuator 508 and the support mount 162, the actuator arms 180 and 182 force the corresponding hinge brackets 170 and 172 and support legs 174 and 176 to rotate, or swing, in a direction away from the golf bag 500 and into the support position.

Also, and as illustrated in FIG. 12, the base ring 134 is coupled to the foot 132 via a solid axle 532 to form a pivoting joint 150 in lieu of the pegs 250 and 252 (shown in FIG. 5).

Figure 13:
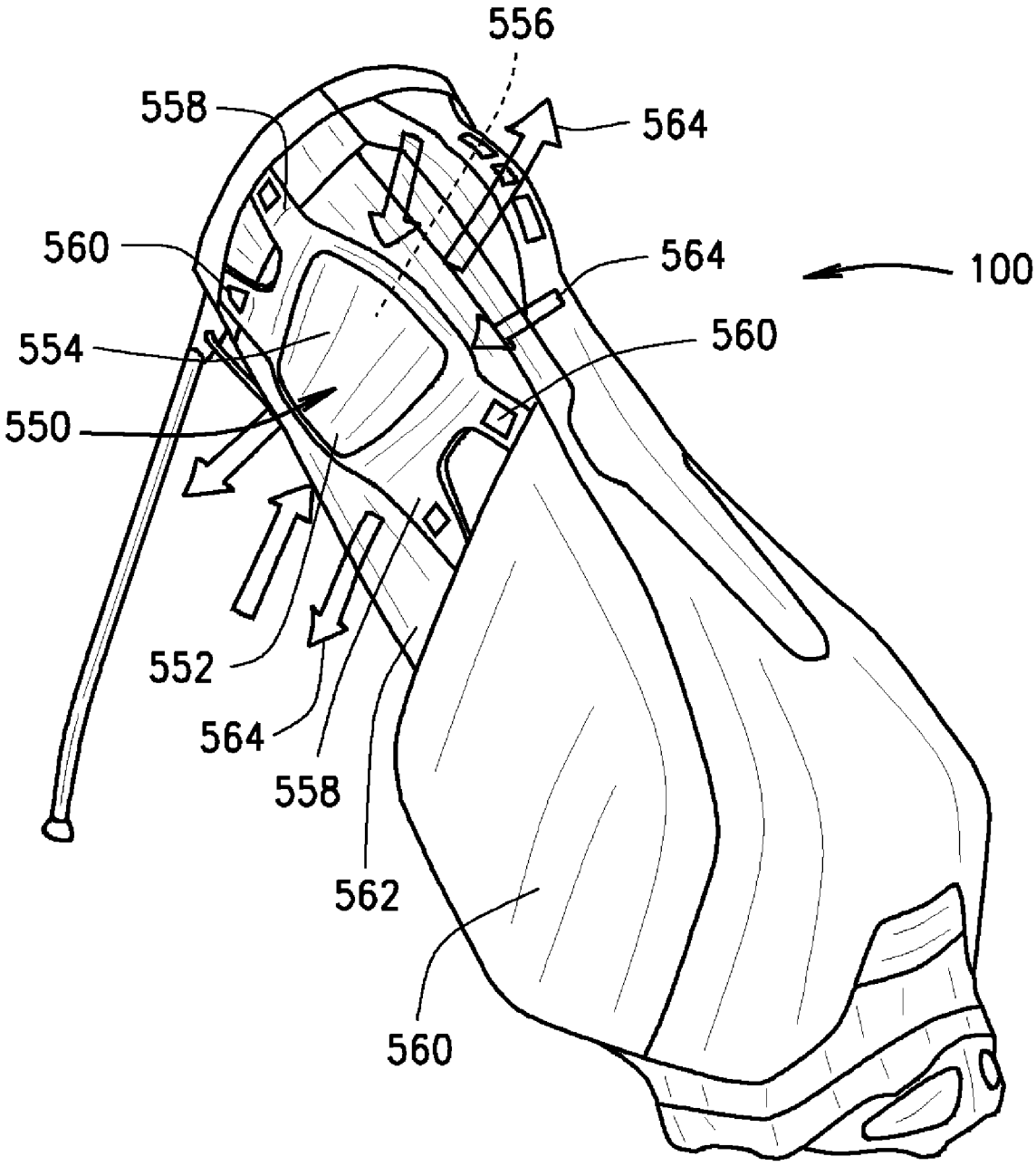
FIG. 13 is a side perspective view of a golf bag illustrating an exemplary lumbar pad according to the present invention.

FIG. 13 is a perspective view of the golf bag 100 illustrating a lumbar member 550 which may be used with, for example, any of the foregoing golf bags, such as the golf bag 100. The lumbar member 550 includes a padded portion 552, having a front side 554 and a back side 556, and a plurality of attachment members 558 extending from the padded portion 552. The padded portion 552 of the lumbar member 550 is positioned on the golf bag 100 such that, while the golf bag 100 is being carried by the golfer, the front side 554 of the padded portion 552 contacts the lower back or side of the golfer giving an added layer of comfort for the golfer. In an exemplary embodiment, the lumbar member 550 is movable and can be adjusted by the golfer to a desired position.

In an illustrative embodiment, the lumbar member 550 is attached to the golf bag 100 by fastening the plurality of attachment members 558 using a Velcro® brand fastener 560. However, other types of fasteners can be utilized, such as, for example, an interlocking device, a tab and slot device, a locking mechanism, a tying system, or a clip. In an alternative embodiment, the back side of the padded portion 552 has an attachment member, such as a Velcro® brand fastener. However, other types of attachment members can be used, such as, for example, an interlocking device, a hook and pile fastener, a tab and slot device, a locking mechanism, a magnet, a tying system, or a clip.

In an illustrative embodiment the lumbar member 550, and specifically the padded portion 552, is fastened to the bag in a manner wherein a clearance is created between an outer covering 562 of the bag and the back side 556 of the padded portion. That is, the padded portion 562 is suspended upon the attachment members 558 in a spaced position from the outer cover 562 of the bag. The clearance or space therebetween defines an airflow path, generally indicated by the arrows 564, for airflow between the lumbar member 558 and the outer covering of the bag 100. The airflow path provides a cushioning effect when the bag is carried, such as with a shoulder harness (not shown) or carrying straps (not shown), with the lumbar member 550 resting upon a lower back region of the person carrying the bag. The airflow path 564 further provides a cooling effect when the bag is carried by the user by permitting airflow in the vicinity of the lumbar member 550.

FIGS. 13 also illustrates pockets 560 which may be used with the golf bag 100. The pockets 560 are attached to the outer covering 562 of the golf bag 100 and are sized to receive golfing accessories therein.

While the invention has been described in terms of various specific embodiments, those skilled in the art will recognize that the invention can be practiced with modification within the spirit and scope of the claims.

What is claimed is:

1. A golf bag comprising:

a body comprising opposite upper and lower ends and a compartment therebetween configured to contain golf clubs; and a self actuating stand coupled to the body, said self actuating stand comprising:

a base ring enclosing said body proximate said lower end;

a foot coupled to said base ring, said base ring pivotably mounted to said foot and circumscribing an entire outer perimeter of the foot, wherein said base ring is movable over said foot between a standing position and an inclined position; and at least one support leg automatically responsive to movement of the base ring relative to the foot, wherein the support leg is positionable in a deployed position when the base ring is moved from the standing position to the inclined position, and wherein the support leg is positionable in a stowed position when the base ring is moved from the inclined position to the standing position, wherein said base ring is movable between the standing position and the inclined position while the foot is maintained stationary with respect to a supporting surface;

wherein said base ring comprises an axle defining a pivoting joint.

2. A golf bag in accordance with claim 1 wherein said pivoting joint is configured for rocking movement relative to said foot to move the base ring between the standing position and the inclined position.

3. A golf bag in accordance with claim 1 wherein said foot comprises a substantially planar bottom surface and a side wall extending from said planar bottom surface, said side wall extending within an outer periphery of said base ring.

4. A golf bag on accordance with claim 1 wherein said foot comprises a substantially planar bottom surface and a side wall extending from said planar bottom surface, said side wall inclined with respect to said planar bottom surface.

5. A golf bag in accordance with claim 1 wherein said foot comprises a substantially planar bottom surface and said planar bottom surface comprises a plurality of footholds extending downward from said planar bottom surface for engagement with the supporting surface, wherein said footholds are configured to support said body when said base ring is in the standing position and when said base ring is in the inclined position.

6. A golf bag in accordance with claim 1 wherein said golf bag further comprises an inner liner contained within said body and surrounding said compartment.

7. A golf bag in accordance with claim 1 wherein said body comprises an internal stay, said base ring coupled to said internal stay.

8. A golf bag in accordance with claim 1 wherein said self actuating stand further comprises an activation rod coupled to said foot and to at least one support leg to automatically extend said support leg when said base ring is in the inclined position.

9. A golf bag in accordance with claim 8 wherein said activation rod is coupled to a retention member positioned on a top wall of said foot.

10. A golf bag in accordance with claim 8 wherein said activation rod is coupled to a planar bottom surface of said foot.

11. A golf bag comprising:

a body comprising opposite upper and lower ends and a compartment therebetween configured to contain golf clubs; and a self actuating stand coupled to the body, said self actuating stand comprising:

a base ring enclosing said body proximate said lower end;

a foot coupled to said base ring, said base ring pivotably mounted to said foot and circumscribing an entire outer perimeter of the foot, wherein said base ring is movable over said foot between a standing position and an inclined position; and at least one support leg automatically responsive to movement of the base ring relative to the foot, wherein the support leg is positionable in a deployed position when the base ring is moved from the standing position to the inclined position, and wherein the support leg is positionable in a stowed position when the base ring is moved from the inclined position to the standing position, wherein said base ring is movable between the standing position and the inclined position while the foot is maintained stationary wit respect to a supporting surface;

wherein said base ring comprises a hinge joint configured for rocking movement relative to said foot to move the base ring between the standing position and the inclined position;

wherein said foot comprises an outwardly extending peg, said hinge joint comprising an opening configured to receive said peg.

12. A golf bag comprising:

a body comprising opposite upper and lower ends and a compartment therebetween configured to contain golf clubs;

a base ring enclosing said body proximate said lower end; and a foot coupled to said base ring, said base ring pivotably mounted to said foot adjacent an outer perimeter of the foot, wherein said base ring is movable over said foot between a standing position and an inclined position, said foot being located stationary in contact with the supporting surface when the base ring is being moved;

wherein said base ring comprises a plurality of footholds extending downward from said base ring for engagement with the supporting surface, and the foot comprises a plurality of footholds for engagement with the supporting surface, wherein a first set of said base ring footholds are substantially aligned with said foot footholds to support said body when said base ring footholds contact the supporting surface and the base ring is in the standing position, and wherein a second set of said base ring footholds are substantially aligned with said foot footholds to support said body when said base ring footholds contact the supporting surface and the base ring is in the inclined position, the second set of base ring footholds being different from the first set.

13. A golf bag comprising:

a body comprising opposite upper and lower ends and a compartment therebetween configured to contain golf clubs;

a base ring extending around a lower periphery of said body, said base ring comprising a side wall and a hinge; and a foot coupled to said hinge wherein said base ring is rockable over said foot, said foot comprising a substantially planar lower surface and an upstanding side wall extending therefrom, said upstanding side wall extending within said side wall of said base ring, said base ring selectively positionable between a standing position and an inclined position when said foot is located stationary on a supporting surface;

wherein said hinge comprises a peg extending outward from said foot and an opening positioned within said base ring and configured to receive said peg.

14. A golf bag comprising:

a body comprising opposite upper and lower ends and a compartment therebetween configured to contain golf clubs;

a base ring extending around a lower periphery of said body, said base ring comprising a side wall and a hinge; and a foot coupled to said hinge wherein said base ring is rockable over said foot, said foot comprising a substantially planar bottom surface and an upstanding side wall extending therefrom, said upstanding side wall extending within said side wall of said base ring, said base ring selectively positionable between a standing position and an inclined position while said foot is located stationary on a supporting surface;

wherein said base ring comprises a plurality of footholds extending downward from said base ring for engagement with the supporting surface, and said foot comprises a plurality of footholds extending downward from the foot for engagement with the supporting surface, wherein some of said base ring footholds are substantially aligned with some of said foot footholds when the base ring is in the standing position, and wherein other of the base ring footholds are substantially aligned with other of the foot footholds when the base ring is in the inclined position.

15. A golf bag comprising:

a body comprising opposite upper and lower ends and a compartment therebetween configured to contain golf clubs;

a base ring extending around said body, said base ring comprising a side wall and a hinge member extending therefrom, said side wall comprising first and second surfaces that are inclined relative to one another; and a foot coupled to said base ring at a location internal to said side wall of said base ring, said foot comprising a substantially planar bottom surface and an upstanding side wall extending therefrom, wherein one of said first and second inclined surfaces is located substantially parallel to a supporting surface to support said body in one of an inclined position and a standing position, wherein the other of the first and second inclined surfaces is located parallel to the supporting surface to support said body in the other of the inclined position and the standing position, and wherein the first and second inclined surfaces of the base ring are selectively positionable between the standing and inclined position, the first and second inclined surfaces of the base ring being selectively positionable relative to the supporting surface without moving the bottom surface of the foot relative to the supporting surface.

16. A golf bag in accordance with claim 15 wherein said hinge member comprises a peg extending outward from said foot and an opening positioned within said base ring and configured to receive said peg.

17. A golf bag in accordance with claim 15 wherein said upstanding side wall of said foot extends between said side wall of said base ring.

18. A golf bag in accordance with claim 15 wherein said planar bottom surface comprises a plurality of footholds extending downward from said planar bottom surface for engagement with the supporting surface, wherein said footholds are configured to support said body when said body is in the standing position and in the inclined position.

19. A golf bag in accordance with claim 15 wherein said base ring comprises a plurality of footholds extending downward from said base ring for engagement with the supporting surface, and said foot comprises a plurality of footholds extending downward from the foot for engagement with the supporting surface, wherein different ones of the base ring footholds align with the footholds of the foot when the base ring is in the standing and inclined positions.

20. A golf bag in accordance with claim 15 wherein said golf bag further comprises an inner lining contained within said body and surrounding said compartment.

21. A golf bag in accordance with claim 15 wherein said foot further comprises a plurality of fasteners configured to retain an inner lining of the golf bag to said foot.

22. A golf bag in accordance with claim 15 further comprising an activation rod coupled to said foot, and at least one support leg operatively coupled to said activation rod to extend said support leg when said bag is inclined.

23. A golf bag in accordance with claim 22 wherein said activation rod is coupled to a retention member positioned on a top wall of said foot.

24. A golf bag in accordance with claim 22 wherein said activation rod is coupled to the planar bottom surface of said foot.

25. A golf bag comprising:

a body comprising an upper and a lower end;

a base ring coupled to said body proximate said lower end, the base ring comprising first and second surfaces for selective engagement with a supporting surface; and a foot coupled to the base ring, the foot comprising a bottom surface and a side wall extending upwardly from the bottom surface and having a complementary shape to a periphery of the base ring;

wherein the base ring is pivotally mounted to the foot to selectively position the base ring relative to the foot and thereby orient the body in one of a standing position and an inclined position, and wherein in both of the standing position and the inclined position one of the first and second surfaces of the base ring is aligned with a portion of the foot and each of the base ring and the foot contacts the supporting surface to support the body.

26. The golf bag of claim 25, wherein the first and second surfaces are canted relative to one another, and wherein:

in the standing position the first surface contacts the supporting surface and the second surface is disengaged from the supporting surface; and in the inclined position the second surface contacts the supporting surface and the first surface is disengaged from the supporting surface.

27. The golf bag of claim 25 wherein the foot remains stationary on the supporting surface as the body is oriented between the standing position and the inclined position.

* * * * *